US011709018B2

(12) United States Patent
Briglia et al.

(10) Patent No.: US 11,709,018 B2
(45) Date of Patent: Jul. 25, 2023

(54) SINGLE PACKAGED AIR SEPARATION APPARATUS WITH REVERSE MAIN HEAT EXCHANGER

(71) Applicants: Alain Briglia, Hangzhou (CN); Remy Kurtz, Hangzhou (CN); Eric Day, Hangzhou (CN); Huali Xie, Hangzhou (CN); Baptiste Fara, Hangzhou (CN); L'Air Liquide, Societe Anonyme pour l'Etude et l'Exploitation des Procedes Georges Claude, Paris (FR)

(72) Inventors: Alain Briglia, Hangzhou (CN); Remy Kurtz, Hangzhou (CN); Eric Day, Hangzhou (CN); Huali Xie, Hangzhou (CN); Baptiste Fara, Hangzhou (CN)

(73) Assignee: L'Air Liquide, Societe Anonyme Pour L'Etude Et L'Expoitation Des Procedes Georges Claude, Paris (FR)

( * ) Notice: Subject to any disclaimer, the term of this patent is extended or adjusted under 35 U.S.C. 154(b) by 213 days.

(21) Appl. No.: 16/958,037

(22) PCT Filed: Dec. 25, 2017

(86) PCT No.: PCT/CN2017/118260
§ 371 (c)(1),
(2) Date: Jun. 25, 2020

(87) PCT Pub. No.: WO2019/126927
PCT Pub. Date: Jul. 4, 2019

(65) Prior Publication Data
US 2021/0063085 A1 Mar. 4, 2021

(51) Int. Cl.
*F25J 3/02* (2006.01)
*F25J 3/04* (2006.01)

(52) U.S. Cl.
CPC ..... *F25J 3/0409* (2013.01); *F25J 3/04206* (2013.01); *F25J 3/04303* (2013.01);
(Continued)

(58) Field of Classification Search
CPC .... F25J 3/0409; F25J 3/04206; F25J 3/04303; F25J 3/04412; F25J 3/04872; F25J 2250/40; F25J 2250/50
See application file for complete search history.

(56) References Cited

U.S. PATENT DOCUMENTS 4,533,375 A 8/1985 Erickson
6,662,594 B2 12/2003 Rampp et al.
(Continued)

FOREIGN PATENT DOCUMENTS

BR 8 403 589 6/1985
CN 201 909 505 7/2011
(Continued)

OTHER PUBLICATIONS

International Search Report and Written Report for PCT/CN2017/118260, dated Sep. 17, 2018.

*Primary Examiner* — Brian M King
(74) *Attorney, Agent, or Firm* — Justin K. Murray

(57) ABSTRACT

A cryogenic air separation setup in a cold box, wherein gaseous oxygen under elevated pressure is produced through hydraulic force caused by the geodetic distance between where liquid oxygen is drawn from the distillation column and where liquid oxygen is vaporized to form gaseous oxygen, such as in an auxiliary evaporator. To increase the vertical distance between the above-mentioned two location, the components are arranged directly below one another in the following sequence: the lower-pressure column, the main condenser evaporator, the higher-pressure column, the subcooler, the main heat exchanger and the auxiliary evapo-
(Continued)

rator). In particular, the main heat-exchanger is positioned with the cold-end on the top to optimize piping expenditure.

10 Claims, 1 Drawing Sheet

(52) U.S. Cl.
CPC ..... *F25J 3/04412* (2013.01); *F25J 2250/40* (2013.01); *F25J 2250/50* (2013.01)

(56) References Cited

U.S. PATENT DOCUMENTS

| | | | | |
|---|---|---|---|---|
| 9,291,389 | B2 | 3/2016 | Kibler et al. | |
| 9,518,778 | B2 | 12/2016 | Rauch et al. | |
| 9,964,353 | B2 | 5/2018 | Lautenschlager et al. | |
| 2001/0029751 | A1* | 10/2001 | Nguyen | F25J 3/0463 62/643 |
| 2003/0110796 | A1* | 6/2003 | Rampp | F25J 3/04254 62/643 |
| 2012/0240621 | A1 | 9/2012 | Rampp | |
| 2013/0019634 | A1 | 1/2013 | Howard | |
| 2013/0086941 | A1 | 4/2013 | Howard | |
| 2014/0053601 | A1* | 2/2014 | Davidian | F25J 3/0486 62/643 |
| 2014/0223959 | A1* | 8/2014 | Demski | F25J 3/04454 62/643 |
| 2016/0223254 | A1* | 8/2016 | Correia Anacleto | F25J 3/04278 |

FOREIGN PATENT DOCUMENTS

| | | |
|---|---|---|
| CN | 202 382 519 | 8/2012 |
| CN | 104 364 597 | 2/2015 |
| CN | 104 685 310 | 6/2015 |
| CN | 105 051 476 | 11/2015 |
| CN | 105 934 642 | 9/2016 |
| CN | 106 016 969 | 10/2016 |
| CN | 106 839 652 | 6/2017 |
| DE | 2020 15004181 | 7/2015 |
| EP | 2 767 787 | 8/2014 |
| WO | WO 2015/026586 | 2/2015 |

* cited by examiner

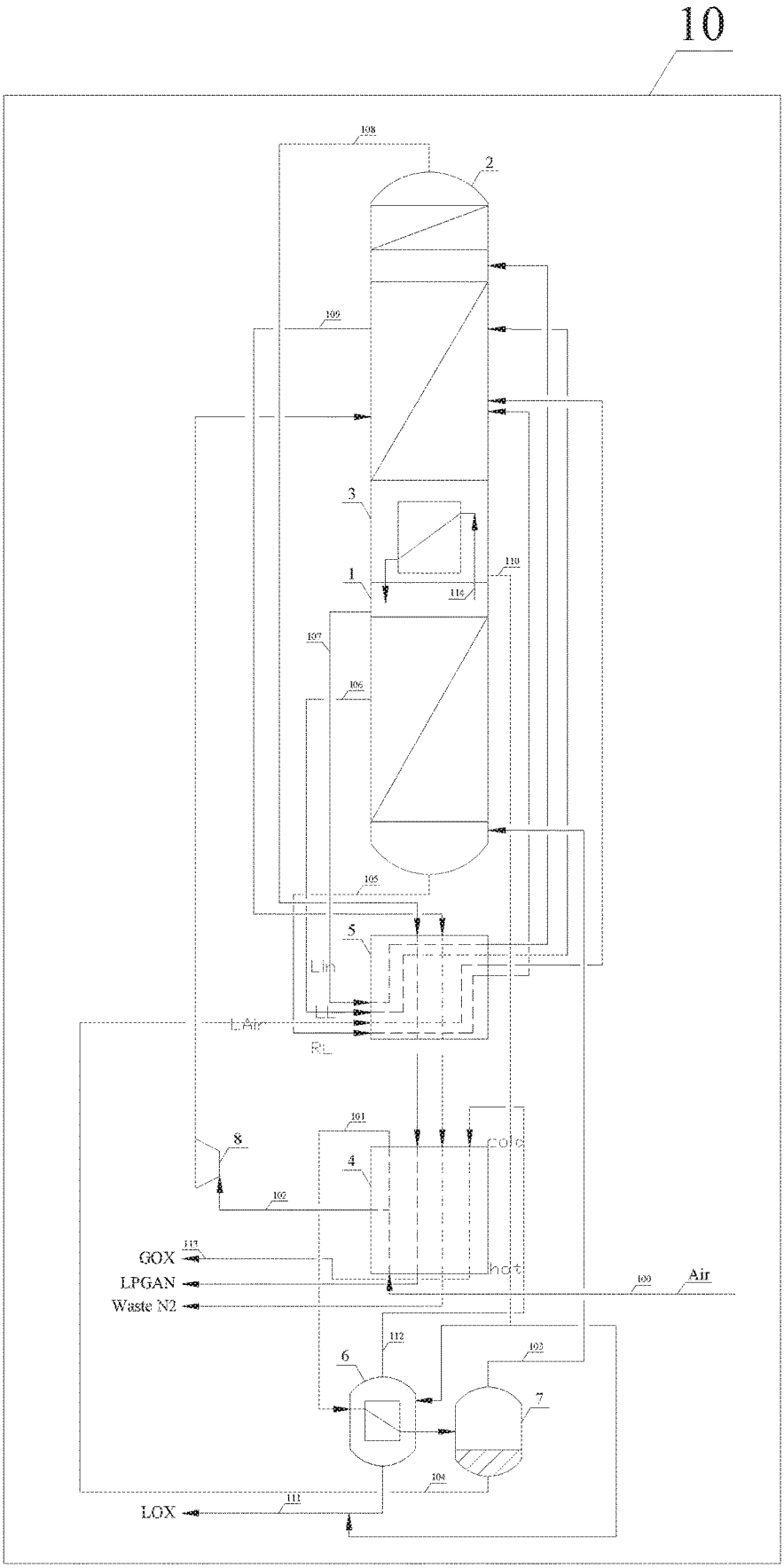
10
108
2
109
3
1
110
114
107
106
105
5
Lin
LL
LAir
RL
101
8
cold
4
102
GOX
113
LPGAN
hot
Waste N2
100
Air
112
6
103
7
104
LOX
111

SINGLE PACKAGED AIR SEPARATION APPARATUS WITH REVERSE MAIN HEAT EXCHANGER

CROSS REFERENCE TO RELATED APPLICATIONS

This application is a § 371 of International PCT Application PCT/CN2017/118260, filed Dec. 25, 2017, which is herein incorporated by reference in its entirety.

FIELD OF THE INVENTION

This invention relates to air separation process and apparatus, in particular cryogenic air separation process and apparatus.

BACKGROUND OF THE INVENTION

Rectification of air under cryogenic conditions to produce large amount of high purity oxygen, nitrogen is a well-known technology and has wide applications in industries such as steel, petrochemical, combustion and electronics. Cryogenic air separation apparatus for producing both nitrogen and oxygen generally comprises at least two distillation columns operating at different pressure, heat exchanging units and rotating machines such as turbines, compressors and pumps. To reduce capital investment and operational cost as well as increase reliability of the apparatus, it is advantageous to minimize the number of rotating machines employed and to optimize the layout of various components and piping.

Different applications often require gaseous or liquid air separation products at distinct pressure. For instance, float glass and non-ferrous metals application needs gaseous oxygen product at a low-medium pressure typically between 2 to 10 bara. Since gaseous oxygen is produced through vaporization of liquid oxygen withdrawn from the bottom of a column operating at a lower pressure around 1~2 bara, a rotating machine such as a liquid pump or a gaseous compressor is sometimes used to raise the pressure of oxygen product to the desired range.

U.S. Pat. No. 6,662,594 describes a process and an apparatus capable of increasing the pressure of oxygen vaporized in a side condenser through hydraulic force. In the apparatus disclosed, housed in a single cold box, from the bottom up in a vertical direction, there are in sequence a side condenser, a subcooler, a main heat exchanger, a column operated at higher pressure, a main condenser and a column operated at lower pressure. Although an extra oxygen pump may be eliminated, the layout of the device components in the cold box is not optimized from a piping arrangement perspective.

SUMMARY OF THE INVENTION

The objective of certain embodiments of the invention is to optimize the arrangement of various components, including equipment and piping, in an air separation apparatus to save construction cost and time, footprint of the equipment on site, as well as improve reliability.

In particular, the invention focuses on a setup in a cold box, wherein gaseous oxygen under elevated pressure is produced through hydraulic force caused by the geodetic distance between where liquid oxygen is drawn from the distillation column and where liquid oxygen is vaporized to form gaseous oxygen, such as in an auxiliary evaporator.

In one aspect, the invention discloses an air separation apparatus comprising a main air compressor and an air cooling unit in flow communication with an air purification unit to produce a compressed and purified feed air stream as well as a first column, a main condenser evaporator and a second column, which are arranged in above sequence below one another and wherein the first column is operated at a higher pressure than the second column. The air separation apparatus also comprises an auxiliary evaporator having a liquefaction space and a vaporization space, which is disposed below the bottom of the first column. In addition, there is a main heat exchanger disposed in between the first column and the auxiliary evaporator for indirect heat exchange between the compressed and purified feed air stream and return gaseous streams from the second column. The apparatus further includes means for introducing the compressed and purified feed air stream into at least the first column, means for introducing at least a fraction from the first column into the second column, and means for transporting a liquid oxygen stream from the main condenser evaporator into the vaporization space of the auxiliary evaporator, wherein at least part of the vaporized gaseous oxygen stream is warmed up in the main heat exchanger to form gaseous oxygen product and the remaining liquid oxygen stream is withdrawn as liquid oxygen product, and means for providing refrigeration to the air separation apparatus. In such an air separation apparatus, the main heat exchanger is set up in a way that the return gaseous streams from the distillation columns enter from the cold end at the top, and exit from the warm end at the bottom of the main heat exchanger.

The air separation apparatus may further comprise a subcooler disposed in between the first column and the main heat exchanger, wherein the return gaseous streams undergo heat exchange with liquid streams passed from the main column, then said return gaseous streams enter into the cold end at the top of the main heat exchanger.

In another aspect, it is disclosed a process for producing gaseous oxygen product under elevated pressure in the air separation apparatus according to claim 1, comprising: cooling a compressed and purified feed air stream in the main heat exchanger through indirect heat exchange with return gaseous streams from the second column followed by introducing at least part of gaseous feed air stream into the first column; separating the gaseous feed air stream into oxygen-rich liquid at the bottom of the first column and transporting said stream into the second column to form bottom liquid and waste nitrogen; condensing medium pressure gaseous nitrogen from the top of the first column against bottom liquid from the second column in the main condenser evaporator to form reflux for the first column and liquid oxygen; withdrawing liquid oxygen from the main condenser evaporator into the vaporization space of the auxiliary evaporator, wherein at least part of the vaporized gaseous oxygen stream is warmed up in the main heat exchanger to form gaseous oxygen product and the remaining liquid oxygen stream is withdrawn as liquid oxygen product; providing refrigeration to the air separation apparatus through expanding at least part of the compressed and purified feed air stream in a turbine expander before introducing it into the second column or optionally through external source. The main heat exchanger is set up in a way that the return gaseous streams enter from the cold end at the top, and exit from the warm end at the bottom of the main heat exchanger.

The process of the invention may further comprise a step, wherein the liquid feed air stream, the oxygen-rich liquid, the lean liquid and the liquid nitrogen are subcooled in a subcooler against return gaseous streams including waste nitrogen and optionally low pressure gaseous nitrogen before being introduced into the second column.

By disposing the main heater exchanger and optionally the subcooler in between the first column and the auxiliary evaporator, a compact cold box may be built to house all components requiring heat insulation, thus saving cost and footprint on site. In addition, placing the subcooler on top of the main heat exchanger, which is disposed cold end up, allows return gaseous streams drawn from the distillation column to first pass the subcooler, then enter directly through the cold end into the main heat exchanger, therefore results in a very low expenditure on piping and an even more optimized footprint.

DESCRIPTION OF THE DRAWINGS

The invention is illustrated schematically by an exemplary embodiment in the attached drawing and is described in detail below with reference to the drawing, wherein:

The FIGURE shows a cold box comprising a distillation column system including a subcooler, a main heat exchanger and an auxiliary evaporator according to the present invention.

DETAILED DESCRIPTION OF THE INVENTION

Further features, advantages and possible applications of the invention are apparent from the following description of working and numerical examples and from the drawings. All described and/or depicted features on their own or in any desired combination form the subject matter of the invention, irrespective of the way in which they are combined in the claims or the way in which said claims refer back to one another.

Methods and devices for cryogenic air separation are known. Such an apparatus generally comprises a main air compressor, which can increase the pressure of ambient pressure feed air stream, an air cooling unit, such as a water cooling tower and an air purification unit employing adsorbents to remove hydrocarbons, carbon dioxide and water from the feed air stream. These components usually operate at temperatures at least above 0° C., thus do not need heat insulation from the atmosphere.

Many components of an air separation apparatus work under cryogenic conditions below −50° C., mostly below −100° C. To provide heat insulation from the atmosphere, these components, for instance distillation column(s), heat exchanging units(s), condenser evaporator(s), phase separator(s), cryogenic pump(s)/expander(s) and interconnecting piping(s) need to be housed in one or more cold boxes. A cold box is an insulating casing that completely encompasses by means of outer walls a heat-insulated inner chamber, which is commonly filled in the space between the outer wall and the contained components with pulverulent materials such as perlite.

Separation columns are construed as distillation or fractionation sections, wherein gas phase and liquid phase are in contact to effectively separate various components in a mixed stream. To obtain both nitrogen and oxygen products from a feed air stream, at least two columns are required. A first column may operate at a higher pressure typically in the range of 5~7 bara while a second column may operate at a lower pressure typically in the range of 1~2 bara; and the two columns are in a heat-exchanging relationship through a main condenser evaporator.

Air separation apparatus of the present invention may include two columns, three- or multi-columns and they can be encased in different cold boxes if needed.

An auxiliary evaporator is a condenser-evaporator, which is preferably made as a liquid bath vaporizer: a plate heat exchanger block containing vaporization and liquefaction passages is disposed in a vessel, which is partially filled during operation with the liquid to be vaporized. The liquid is overturned by means of the thermosiphon effect through the vaporization passages of the plate heat exchanger block. The vaporization space is formed by these vaporization passages and by the outside space between the block and tank wall, and the liquefaction space is formed by the liquefaction passages.

A main heat exchanger serves for cooling feed air stream(s) by indirect heat exchange with return streams from the separation columns. In its configuration, the side where streams of higher temperature, such as feed air stream(s), are fed into is referred to as "the warm end"; and the side where streams of lower temperature, such as return streams from the separation columns, are fed into is referred to as "the cold end". The warm end and the cold end are normally oppositely situated on a main heat exchanger. Conventionally, during operation, the main heat exchanger is set up with warm end on the top to receive feed air stream(s). If the cold end were on top of the main heat exchanger and cold liquid streams were introduced therefrom, in the incident of lack of warm feed air streams, such cold liquid streams would flow to the warm end at the bottom of the main heat exchanger under gravity, thus creating a risk of damaging the warm end. However, in the present invention, the main heat exchanger is arranged cold end on top provided that no liquid streams are fed into the warm end of the main heat exchanger.

Often the feed liquid streams for the lower-pressure column are subcooled against the return gaseous streams of the lower-pressure column by indirect heat exchange in a subcooler. Means for transporting/introducing streams include necessary pipelines, pressure relieving or expanding devices and connection ports.

In a double-column system as described above, oxygen is firstly drawn from the bottom of the lower-pressure column in a liquid form having the same pressure as the point of withdrawal, usually at 1.1~1.5 bara. In the case that gaseous oxygen products under elevated pressure is desired, several approaches may be taken. One approach is to compress the gaseous oxygen stream directly after the liquid oxygen stream is vaporized in a heat-exchanging device. Another approach is to pump a liquid oxygen stream before its vaporization, and yet another approach of the present invention is to raise the pressure of a liquid oxygen stream through hydraulic driving force. The latter approach has the advantage of eliminating the use of rotating machines such as pumps and compressors, thus improving the reliability of the entire air separation apparatus.

In the present invention, the auxiliary evaporator is located outside the lower-pressure column and its vaporization side is under a higher pressure than the lower-pressure column due to hydraulic driving force; as a result, the oxygen vaporized there is then obtained under a correspondingly increased pressure as a gaseous product. Apparently, when vertical distance between the lower-pressure column and the auxiliary evaporator is greater, the pressure at the vaporization side is higher. Therefore, preferably, the components are arranged directly below one another in the following sequence: the lower-pressure column, the main condenser evaporator, the higher-pressure column, the subcooler, the main heat exchanger and the auxiliary evaporator (optionally with a phase separator). Specifically, all components may be encompassed in a single cold box in a compact and economical manner. Here, a component or device is situated "below" another component or device when the top edge thereof is situated at a lower geodetic level than the bottom edge of the other component. In this case there can, but need not be, a vertical line that passes through both components. In the projection onto a horizontal plane, the cross sections of the two devices can intersect, but can also be arranged completely offset from one another. The expressions "above", "on top" and "in between" are to be understood similarly.

In the embodiment of FIG. 1, a compressed and purified feed air stream 100 is delivered under a pressure of, for example, 5 to 10 bara and enters a main heater exchanger 4 from the warm end disposed at the bottom of the main heat exchanger 4. Within the main heat exchanger 4, the compressed and purified feed air stream 100 is divided into two parts, a first part of feed air stream 101 passes the entire passage of the main heat exchanger 4 and is withdrawn from the cold end at the top of the main heat exchanger 4; it is then supplied to the liquefaction space of an auxiliary evaporator 6, where it condenses. The mixture is then potentially introduced into a phase separator 7. The portion that remains as gaseous feed air stream 103 is choked when needed to roughly 5-7 bara and fed into a first column 1 at a higher pressure; the portion that constitutes a liquid feed air stream 104 is passed through a subcooler 5 disposed above the main heater exchanger 4 followed by being choked to a pressure of roughly 1.1-2 bara and being delivered into a second column 2 at a lower pressure.

A second part of feed air stream 102 is withdrawn from the main heat exchanger in an intermediate point to remain in gaseous phase. This stream is then expanded in a turbine expander 8 (for example braked by a generator) to form a mixture, which is then delivered into the second column 2 to provide refrigeration for the entire air separation apparatus 9. Alternatively, cold supply may be achieved by delivering very cold liquid from the outside (liquid assist). Liquid oxygen, liquid nitrogen, liquefied air or any other liquid mixture of air components can be used to meet the cold demand.

In the first column 1, gaseous feed air stream 103 is separated into medium pressure gaseous nitrogen 114 at the top and oxygen-rich liquid at the bottom. The medium pressure gaseous nitrogen 114 is condensed in a main condenser evaporator 3 against the vaporizing bottom liquid of the second column 2. The liquid nitrogen formed thereby is in one part returned as reflux to the first column 1 and in another part drawn out as liquid nitrogen stream 107. Optionally, lean liquid 106 may be withdrawn at a location below the liquid nitrogen 107 from the first column 1. Oxygen-rich liquid 105 is also taken from the bottom of the first column 1. Part or all three above streams constitute "a fraction" from the first column 1 and are delivered into the second column 2 after being subcooled in the subcooler 5 against return gaseous streams. Return gaseous streams refer to gaseous products of the second column 2, including waste nitrogen 109 and optionally low pressure gaseous nitrogen 108, both of which act as cooling medium for subcooling liquid streams from the first column 1 in the subcooler 5. After passing through the subcooler 5, these return gaseous streams enter into the cold end at the top of and exit from the warm end at the bottom of the main heat exchanger 4 as ambient temperature low pressure gaseous nitrogen and waste nitrogen. Since the orientation of the main heat exchanger 4 is aligned with the temperature increase direction of the return gaseous streams, it is possible to minimize the length of pipelines connecting the subcooler 5 to the main heat exchanger 4, thus reducing piping expenditure and assembling time on site or in workshop, as well the overall cold box footprint.

Bottom liquid of the second column 2 comprises liquid oxygen, which is withdrawn as stream 110. This stream undergoes a hydrostatic pressure increase and is fed into the vaporization space of the auxiliary evaporator 6 to be vaporized. For a geodetic gradient of 20 m, the hydrostatic pressure increase in about 2.3 bara. The gaseous oxygen stream 112 formed here is routed to the cold end of the main heat exchanger 4 and finally delivered to consumer as a gaseous oxygen product 113. The oxygen that has remained liquid is withdrawn as liquid oxygen product 111.

From the foregoing description, one skilled in the art can easily ascertain the essential characteristics of this invention and, without departing from the spirit and scope thereof, can make various changes and modifications of the invention to adapt it to various usages and conditions.

While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims. The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary.

Optional or optionally means that the subsequently described event or circumstances may or may not occur. The description includes instances where the event or circumstance occurs and instances where it does not occur.

Ranges may be expressed herein as from about one particular value, and/or to about another particular value. When such a range is expressed, it is to be understood that another embodiment is from the one particular value and/or to the other particular value, along with all combinations within said range.

All references identified herein are each hereby incorporated by reference into this application in their entireties, as well as for the specific information for which each is cited.

The invention claimed is:

1. An air separation apparatus comprising:

(a) a first column, a main condenser evaporator and a second column, wherein the second column surmounts the first column and the first column and the second column are thermally connected by the main condenser evaporator, wherein the first column is operated at a higher pressure than the second column;

(b) an auxiliary evaporator having a liquefaction space and a vaporization space, the auxiliary evaporator being disposed below the bottom of the second column;

(c) a main heat exchanger being disposed in between the first column and the auxiliary evaporator for indirect heat exchange between the compressed and purified feed air stream and return gaseous streams from the second column, the main heat exchanger having a warm end and a cold end;

(d) means for introducing a compressed and purified feed air stream into at least the first column after cooling in the main heat exchanger;

(e) means for introducing at least a fraction from the first column into the second column;

(f) means for transporting a liquid oxygen stream from the main condenser evaporator into the vaporization space of the auxiliary evaporator, wherein at least part of the vaporized gaseous oxygen stream is warmed up in the main heat exchanger to form gaseous oxygen product and the remaining liquid oxygen stream is withdrawn as liquid oxygen product; and (g) means for providing refrigeration to the air separation apparatus;

wherein the main heat exchanger is configured such that the return gaseous streams enter from the cold end at the top, and exit from the warm end at the bottom of the main heat exchanger.

2. The air separation apparatus of claim 1, further comprising a subcooler disposed in between the first column and the main heat exchanger, wherein the return gaseous streams undergo heat exchange with liquid streams passed from the first column, then said return gaseous streams enter into the cold end at the top of the main heat exchanger.

3. The air separation apparatus of claim 2, further comprising means for introducing a first part of feed air stream into the liquefaction space of the auxiliary evaporator and after partial or total condensation therein, further into a phase separator for separation into a gaseous feed air stream and a liquid feed air stream.

4. The air separation apparatus of claim 3, wherein the means for providing refrigeration to the air separation apparatus further comprises a turbine expander configured to expand a second part of feed air stream before the second part of feed air stream enters into the first column or the second column in order to provide refrigeration to the air separation apparatus.

5. The air separation apparatus of claim 1, wherein the second column, the main condenser evaporator, the first column, optionally the subcooler, the main heat exchanger and the auxiliary evaporator are housed in one cold box.

6. A process for producing gaseous oxygen product under elevated pressure in the air separation apparatus according to claim 1, comprising:

(a) cooling the compressed and purified feed air stream in the main heat exchanger through indirect heat exchange with return gaseous streams from the second column followed by introducing at least part of the compressed and purified feed air stream into the first column;

(b) separating the gaseous feed air stream into oxygen-rich liquid at the bottom of the first column and transporting said oxygen-rich liquid into the second column to form a bottom liquid and waste nitrogen;

(c) condensing a gaseous nitrogen from the top of the first column against bottom liquid from the second column in the main condenser evaporator to form reflux for the first column and liquid oxygen;

(d) withdrawing liquid oxygen from the main condenser evaporator into the vaporization space of the auxiliary evaporator, wherein at least part of the vaporized gaseous oxygen stream is warmed up in the main heat exchanger to form gaseous oxygen product and the remaining liquid oxygen stream is withdrawn as liquid oxygen product; and (e) providing refrigeration to the air separation apparatus through expanding at least part of the compressed and purified feed air stream in a turbine expander before introducing it into the second column or optionally through external source.

7. The process of claim 6, wherein the compressed and purified feed air stream is divided into at least a first part of feed air stream and a second part of feed air stream in the main heat exchanger, the first part of feed air stream being delivered into the liquefaction space of the auxiliary evaporator to be partially or totally condensed and further delivered into a phase separator for separation into the gaseous feed air stream and a liquid feed air stream, and the gaseous feed air stream being fed into the first column and the liquid feed air stream being fed into the second column.

8. The process of claim 6, wherein a liquid nitrogen and a lean liquid are removed from the first column and transported into the second column.

9. The process of claim 8, wherein low pressure gaseous nitrogen is withdrawn from the second column.

10. The process of claim 9, wherein the liquid feed air stream, the oxygen-rich liquid, the lean liquid and the liquid nitrogen are subcooled in a subcooler against return gaseous streams including waste nitrogen and optionally low pressure gaseous nitrogen before being introduced into the second column.

* * * * *